US005256946A

United States Patent [19]

Garbowicz et al.

[11] Patent Number: 5,256,946

[45] Date of Patent: Oct. 26, 1993

[54] GASEOUS DISCHARGE LAMP SYSTEM WITH AUXILIARY LAMP

[75] Inventors: Glenn D. Garbowicz, Rosemont; Edmond Daniel, Chicago, both of Ill.

[73] Assignee: North American Philips Corporation, New York, N.Y.

[21] Appl. No.: 856,771

[22] Filed: Mar. 24, 1992

[51] Int. Cl.[5] ..... H05B 39/10

[52] U.S. Cl. ..... 315/88; 315/90; 315/91; 315/92; 315/93; 315/159

[58] Field of Search ..... 315/88, 91, 156, 159, 315/93, 90, 92, 323, 65, 74, 35

[56] References Cited

U.S. PATENT DOCUMENTS 3,659,146 4/1972 Munson ..... 315/92
3,694,692 9/1972 Pressman ..... 315/93
3,890,534 6/1975 Horowitz ..... 315/91
3,927,348 12/1975 Zawadski ..... 315/88
4,047,076 9/1977 McNamara, Jr. ..... 315/88
4,091,307 5/1978 McNamara, Jr. ..... 315/88
5,072,156 10/1991 Droho ..... 315/232

*Primary Examiner*—Robert J. Pascal
*Assistant Examiner*—Michael B. Shingleton
*Attorney, Agent, or Firm*—Edward Blocker

[57] ABSTRACT

A lighting system having a primary light source and an emergency lamp. The emergency lamp is turned on and remains on upon failure or removal from the system of the primary light source. The system also includes a control device for sensing when the voltage across the primary light source rises above a predetermined level in determining when to turn on the emergency lamp.

5 Claims, 1 Drawing Sheet

GASEOUS DISCHARGE LAMP SYSTEM WITH AUXILIARY LAMP

BACKGROUND OF THE INVENTION

This is an invention in the lighting art. More particularly, it involves an arrangement with a gaseous discharge lamp and an auxiliary lamp. The auxiliary lamp is lighted should the gaseous discharge lamp not light under conditions in which the gaseous discharge lamp otherwise should light.

Gaseous discharge lamps of the metal halide and mercury type are often difficult to re-strike while they are still hot after a short-lived power interruption. Waiting for such a lamp to cool in order that it may be relit could involve a lighting interruption of up to fifteen minutes.

SUMMARY OF THE INVENTION

It is therefore an object of this invention to provide emergency lighting for as long as it takes a high pressure gas discharge lamp to be reignited after the restoration of power following a power failure.

Auxiliary (emergency) illumination of an area normally illuminated by a high pressure gas discharge lamp is provided when the high pressure discharge lamp has burned out or has been removed from its sockets.

Generally speaking, in accordance with the invention, a gaseous discharge lamp system includes a gaseous discharge lamp for connection to a source of voltage and a ballast connected in series with the gaseous discharge lamp. A second lamp is also connected across the source of voltage. A voltage sensor is connected to the source of voltage and is conductive when the gaseous discharge lamp is non-conductive (i.e. turned OFF). The voltage sensor disconnects the second lamp from the source of voltage when the gaseous discharge lamp is conductive (i.e. turned ON). The voltage sensor, which connects the second lamp to the source of voltage when the gaseous discharge lamp is non-conductive includes a semiconductor switching device. The semiconductor switching device is conductive when the gaseous discharge lamp is non-conductive. The semiconductor switching device is non-conductive when the gaseous discharge lamp is conductive.

Still other objects, features and advantages of the invention will, in part, be apparent from the following description and appended claims.

BRIEF DESCRIPTION OF THE DRAWINGS

For a fuller understanding of the invention, reference is had to the following description taken in connection with the accompanying drawings, in which.

DETAILED DESCRIPTION OF THE PREFERRED EMBODIMENTS

Figure 1:
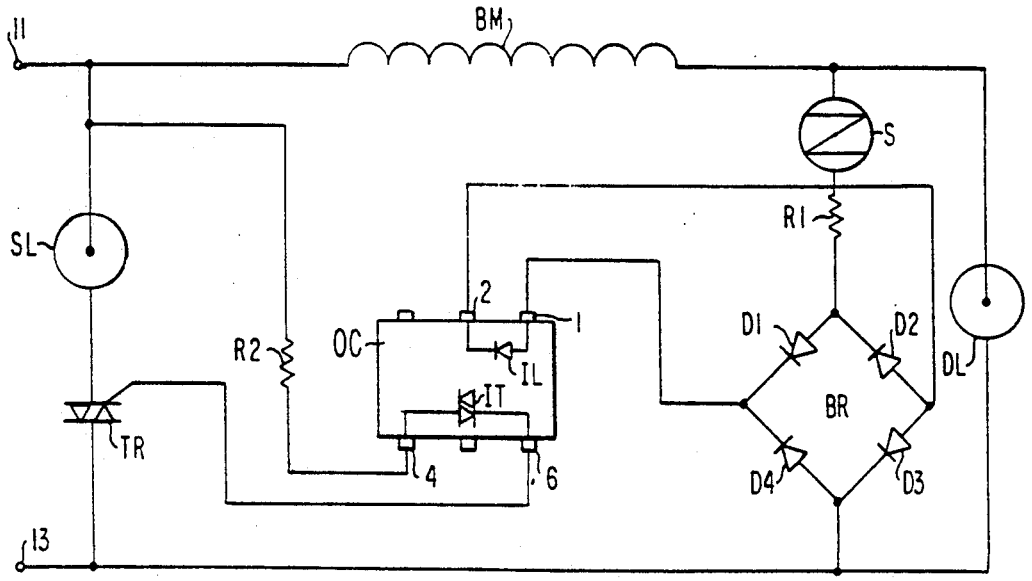
FIG. 1 is a schematic wiring diagram of a gaseous discharge lamp system in accordance with one embodiment of the invention in which the ballast means for the gaseous discharge lamp is a reactor.

Referring to FIG. 1 there is shown therein two terminals 11 and 13 for connection to a suitable source of voltage. Connected in series across the terminals 11 and 13 is a second lamp SL which operates as an emergency lighting source and a triac TR1. Connected to terminal 11 is one end of a ballast means BM in the form of a reactor. The other end of ballast means BM is connected to one terminal of a gaseous discharge lamp DL. The other terminal of lamp DL is connected to terminal 13. Connected in parallel with lamp DL is a sidac S, resistor R1 and full wave bridge circuit BR comprising diodes D1, D2, D3 and D4.

One of the diagonals of bridge BR, that is the terminals between D1 and D4 and that between D2 and D3, is connected to two terminals 1 and 2, of an opto-coupler OC. Connected internally in opto-coupler OC between these two terminals of the opto-coupler is an internal light emitting diode IL. Two other terminals, 4 and 6, of opto-coupler OC are connected to two terminals of a light sensitive internal triac IT. One of these external terminals, 4, of opto-coupler OC is connected through resistor R2 to terminal 11. The other of these external terminals, 6, of opto-coupler OC is connected to the gate of triac TR.

In operation when terminals 11 and 13 are connected to a suitable source of voltage gaseous discharge lamp DL should normally turn on as a result of that voltage. When lamp DL turns on the voltage across it is reduced and consequently there is insufficient voltage to cause the semiconductor switching device, namely, sidac S to turn on. Should gaseous discharge lamp DL not turn on when terminals 11 and 13 are connected to a proper source of voltage then sufficient voltage is applied to sidac S to cause it to conduct through resistor R1 and bridge BR. Upon conduction a voltage is developed across terminals 1 and 2 of opto-coupler OC to cause the internal light emitting diode IL to conduct and emit light. The light from diode IL causes light sensitive internal triac IT to conduct and to place a signal upon the gate of triac TR. This causes triac TR to conduct current which illuminates lamp SL. This condition will continue until gaseous discharge lamp DL is ignited.

Upon ignition of lamp DL, as indicated above, semiconductor switching device sidac S will no longer have a sufficient voltage applied to it to cause it to conduct. As a result voltage is no longer applied to terminals 1 and 2 of opto-coupler OC and light emitting diode IL ceases to produce light. As a result internal triac IT turns off removing the gate signal to triac TR. This causes triac TR to cease conduction and consequently lamp SL is turned off.

Figure 2:
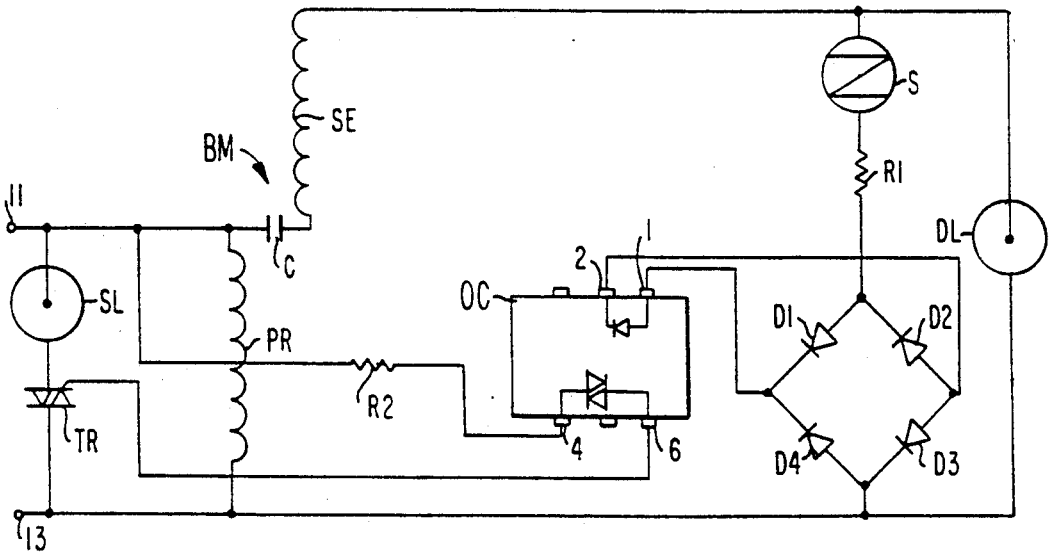
FIG. 2 is a schematic wiring diagram of a gaseous discharge lamp system in accordance with an alternative embodiment of the invention in which the ballast means is an autotransformer.

The system of FIG. 2 is similar to that of FIG. 1 accept that the ballast means of FIG. 2 is in the form of an autotransformer comprising primary winding PR and secondary winding SE with a capacitor C connected between those windings in the well understood manner. Except for the use of an autotransformer as opposed to a reactor, the operation of the other elements of FIG. 2, which bear the same legends as the similar elements of FIG. 1, is the same as the operation of those elements of FIG. 1.

It should be apparent that various modifications of the above will be evident to those skilled in the art and that the arrangement described herein is for illustrative purposes and is not to be considered restrictive.

What is claimed is:

1. A lighting system, comprising:

a power source for producing power at an associated voltage;

a first lamp for connection to said power source;

ballast means for ballasting said first lamp;

a second lamp;

control means responsive to the voltage across said first lamp for producing a control signal and adapted to consume power only when producing said control signal, said control means including a recitifier in series circuit with a semiconductor switching device, said series circuit being connected in parallel with said first lamp; and switching means responsive to said control signal for placing said second lamp across said power source whereby said second lamp is lit, said switching means including a triac connected in series with said second lamp and being turned on in response to said control signal;

wherein said triac includes a gate and wherein said control means further includes an opto-coupler connected between the gate of said triac and said rectifier.

2. The lighting system in accordance with claim 1, wherein said semiconductor switching device is a SIDAC.

3. A lighting system, comprising:

a power source for producing power at an associated voltage;

a first lamp for connection to said power source;

ballast means for ballasting said first lamp;

a second lamp;

control mean responsive to the voltage across said first lamp for producing a control signal, said control means adapted to consume power only when producing said control signal; and switching means responsive to said control signal for placing said second lamp across said power source whereby said second lamp is lit;

wherein said control means includes an opto-coupler for supplying said control signal to said switching means.

4. A lighting system, comprising:

a power source for producing power at an associated voltage;

a first lamp for connection to said power source;

ballast means for ballasting said first lamp;

a second lamp;

control means responsive to the voltage across said first lamp for producing a control signal and adapted to consume power only when producing said control signal, said control means including voltage sensing means for sensing the voltage across said first lamp at which said control means produces said control signal; and switching means responsive to said control signal for placing said second lamp across said power source whereby said second lamp is lit;

wherein said control means further includes an opto-coupler for supplying said control signal to said switching means.

5. A lighting system in accordance with claim 4, wherein said voltage sensing device is a SIDAC.

* * * * *